US008207796B2

(12) United States Patent
Mangaiahgari

(10) Patent No.: US 8,207,796 B2
(45) Date of Patent: Jun. 26, 2012

(54) STRIPLINE TERMINATION CIRCUIT HAVING RESONATORS

(75) Inventor: Sankara N. Mangaiahgari, Singapore (SG)

(73) Assignee: Delphi Technologies, Inc., Troy, MI (US)

( * ) Notice: Subject to any disclaimer, the term of this patent is extended or adjusted under 35 U.S.C. 154(b) by 345 days.

(21) Appl. No.: 12/582,116

(22) Filed: Oct. 20, 2009

(65) Prior Publication Data

US 2011/0090027 A1 Apr. 21, 2011

(51) Int. Cl.
*H01P 1/24* (2006.01)

(52) U.S. Cl. ..... 333/22 R

(58) Field of Classification Search ..... 333/22 R, 333/81 A, 81 R, 204
See application file for complete search history.

(56) References Cited

U.S. PATENT DOCUMENTS

| | | | | |
|---|---|---|---|---|
| 5,208,561 | A | 5/1993 | Delestre et al. | |
| 6,396,264 | B1 * | 5/2002 | Tamaki et al. | 324/249 |
| 6,600,384 | B2 * | 7/2003 | Mohwinkel et al. | 333/22 R |
| 7,161,244 | B2 | 1/2007 | Fournier et al. | |

OTHER PUBLICATIONS

European Search Report dated Jan. 19, 2011.

* cited by examiner

*Primary Examiner* — Stephen Jones
(74) *Attorney, Agent, or Firm* — Lawrence D. Hazelton

(57) ABSTRACT

A technique of realizing a termination circuit using coupled resonators in stripline configuration of a circuit presented. The circuit absorbs RF energy incident on its input over a frequency band of interest, and dissipates it in to the dielectric substrate, thereby acting like an effective termination in the frequency band. The resonant elements may be constructed in edge-coupled or broad-side coupled stripline configuration. The technique may be extended to build microstrip line termination with edge-coupled resonators. The technique may further be extended to realize attenuators over a narrow band.

16 Claims, 4 Drawing Sheets

STRIPLINE TERMINATION CIRCUIT HAVING RESONATORS

TECHNICAL FIELD

The present invention generally relates to the effective absorption of radio frequency (RF) energy, and more particularly relates to a termination circuit, such as a stripline termination circuit that can be used to terminate an isolated port in a microwave circuit, over a desired band of frequencies.

BACKGROUND OF THE INVENTION

Antenna feed networks are commonly employed in RF systems that operate in various microwave or millimeter wave frequency bands such as automotive radar, according to one example. Typical antenna feed networks include power splitters, directional couplers, rat-race hybrids, branch-line couplers, etc., that usually require the isolated ports terminated with a resistance about equal to the characteristic impedance of the transmission lines. Generally, an ideal termination circuit is a one-port device that absorbs RF energy incident on the port and reflects none. In general, it is typically sufficient that the termination is effective over the frequency band of operation.

At higher microwave frequencies, terminations are often achieved by dispensing liquid resistive material over an area on open transmission lines, such as microstrip, that attenuates RF energy. However, this technique is difficult to implement in shielded transmission line structures, such as stripline, where the conducting strip is sandwiched between dielectric substrates, with ground metallization on the outer sides.

SUMMARY OF THE INVENTION

In accordance with one aspect of the present invention, a termination circuit to terminate an isolated port is provided. The termination circuit comprises a first ground plane, a conductive transmission line having a termination end, and a dielectric disposed between the first ground plane and the conductive transmission line to dielectrically isolate the conductive transmission line from the first ground plane. The termination circuit further includes one or more resonating elements electrically coupled to the conductive transmission line for dissipating energy from the transmission line into the dielectric to provide a termination over a desired frequency band, wherein the one or more resonating elements are not in direct contact with the conductive transmission line.

According to another aspect of the present invention, a stripline termination circuit to terminate an isolated port is provided. The circuit comprises a conductor strip placed between two metalized coplanar ground planes, separated by two dielectric substrates of predesigned thicknesses. RF energy present on the coupled strip is electrically coupled to one or more resonating elements over the desired frequency band and is dissipated in the dielectric substrates. The resonating elements are not in direct contact with the conductor strip, and are constructed in edge-coupled or broad-side coupled stripline configurations, according to various embodiments.

These and other features, advantages and objects of the present invention will be further understood and appreciated by those skilled in the art by reference to the following specification, claims and appended drawings.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
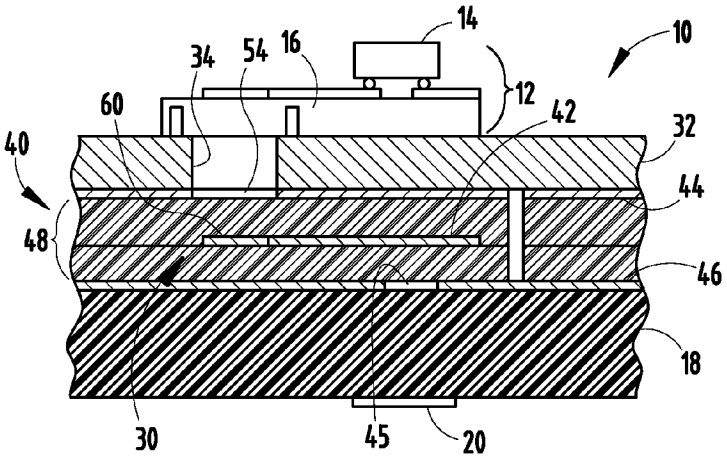
FIG. 1 is a cross-sectional view of a transceiver, employing a stripline feed network having one or more stripline to waveguide transitions and termination circuitry according to one embodiment.

Referring to FIG. 1, a cross-sectional view of an RF system 10 is generally illustrated comprising a transceiver or module 12, mounted on an aluminum block 32, coupled through a waveguide 34 in the block 32, followed by a transition 30 to a stripline 40 having stripline feed network 42. The stripline 40 and waveguide 34 are arranged substantially perpendicular (ninety degrees) to each other in this embodiment. The RF system 10 also includes an antenna or radiator 20. The stripline to waveguide transition 30 transitions RF energy between TEM mode propagation in the stripline 40 and $TE_{10}$ mode propagation in the waveguide 34. The RF system 10 may transmit and receive RF energy for use in various systems, such as an automotive radar system operating in the microwave or millimeter wave frequency band, according to one embodiment.

The transceiver device 12 may include a monolithic millimeter wave integrated circuit (MMIC) 14 mounted onto a low temperature co-fired ceramic (LTCC) substrate 16. MMIC 14 may include one or more amplifiers, mixers, and other electrical circuitry. The substrate 16 is shown mounted on the conductive block 32 which has the waveguide 34 formed therein. The waveguide 34 may be realized in aluminum/copper/FR4 or any other rigid support, according to various embodiments. The waveguide 34 is perpendicular to the stripline 40 and its transmission line 42 in the embodiment shown.

The stripline 40 includes a conductive strip or transmission line 42 separated from first (upper) and second (lower)

ground planes 44 and 46 by a dielectric 48 such that line 42 is sandwiched by the dielectric 48. The dielectric is an electrically nonconductive substrate that may be made of two dielectric sheets, according to one embodiment. RF energy is coupled to the antenna or radiator strip 20 on the antenna dielectric substrate 18 through an aperture 45 in the bottom ground plane 46, according to one embodiment. According to other embodiments, a slot radiator or other radiator may be employed.

The stripline 40 is a shielded transmission line with conductive strip or line 42 sandwiched between two dielectric substrates 48, with ground metallization 44 and 46 on either sides of the structure. The stripline 40 offers a cost-effective implementation of the feed network. To effect a signal transmission, stripline 40 is connected by its transmission line 42 to a conductive stripline patch 60.

Figure 2:
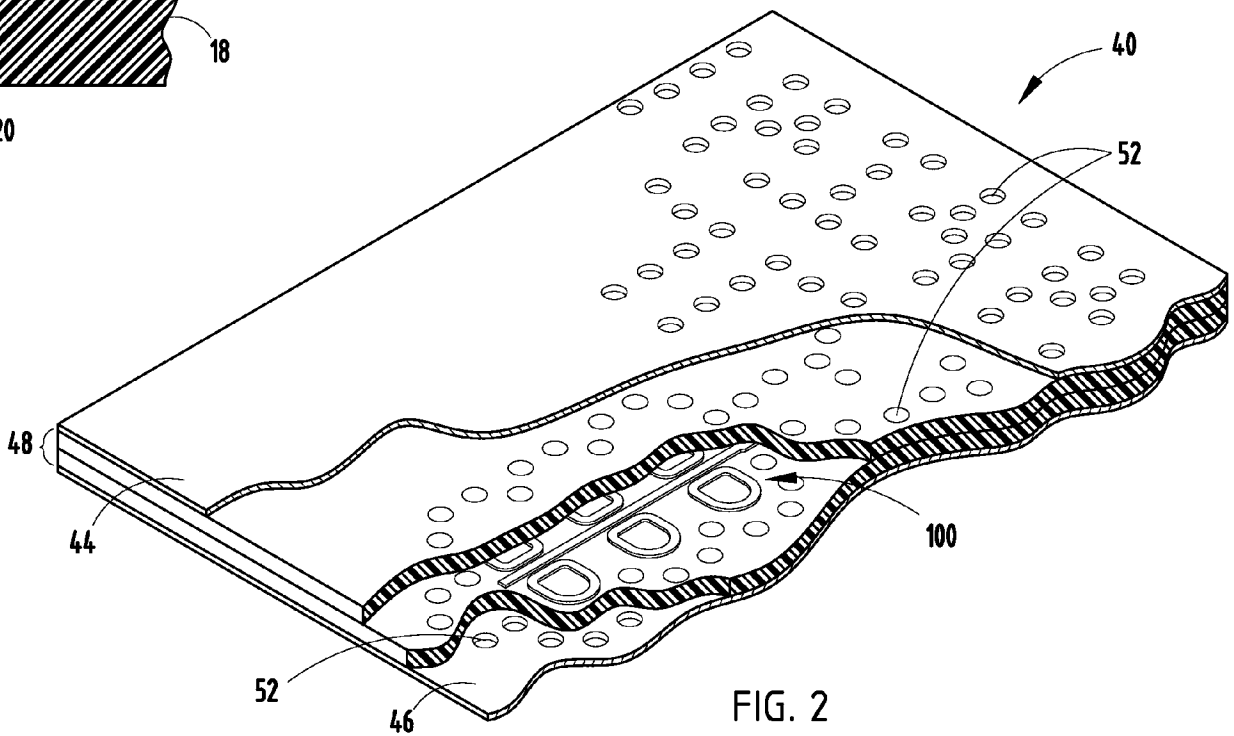
FIG. 2 is a perspective cut away view of a portion of the stripline and its feed ports and termination circuitry shown in FIG. 1.

The stripline 40 is shown in FIG. 2 employing one or more stripline termination circuits 100. The stripline termination circuits 100 may be used to terminate isolated ports of the splitters, such as rat-race hybrid and dummy antenna ports in the feed layer. Input impedance of the stripline termination circuit 100 is approximately equal to 50Ω, according to one embodiment. The stripline termination circuits 100 are essentially formed as printed circuits fabricated on top of the bottom sheet of the dielectric and are shown formed coplanar with other portions of the conductive transmission line 42, according to one embodiment. The stripline termination circuits 100 are provided with resonator elements 110 that serve as resonators to absorb electrical energy at the termination port over a desired bandwidth. The resonators 110 are designed to achieve the desired level of absorption (or input return loss S11 dB) over the desired bandwidth. In the example, simulated response of the termination showed over 10 dB return loss in 75.5 GHz to 77.3 GHz frequency range. However, it should be appreciated that the stripline termination circuit 100 may be designed to cover different frequency bands.

As shown in FIG. 2, the stripline 40 is formed on top of the bottom dielectric layer such that the conductive transmission line 42 is separated from and sandwiched between the first and second ground planes 44 and 46 by the intermediate dielectric 48. As such, the conductive transmission line 42 is electrically isolated from the upper and lower ground planes 44 and 46 which electrically shield the transmission line 42. In the embodiment shown, the conductive transmission line 42 forming the termination circuit 100 is formed coplanar with the remaining conductive transmission line 42 that is coupled to feed transitions one or more waveguides. However, it should be appreciated that the termination circuit 100 may be fabricated above or below other portions of the conductive transmission line, according to other embodiments.

Figure 3:
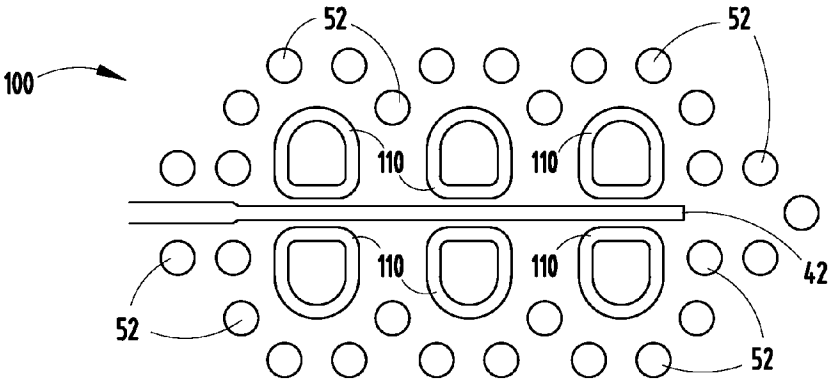
FIG. 3 is an enlarged top view of a stripline termination circuit shown in FIG. 2 employing resonator elements according to a first embodiment.

One stripline termination circuit 100 shown in FIG. 2 is illustrated further in FIG. 3 having a plurality of resonator elements 110 separate from and in close proximity to the conductive transmission line 42 such that they are electrically coupled to the conductive transmission line 42, according to a first embodiment. In this embodiment, the resonator elements 110 each have a portion that is parallel to the conductive transmission line 42 and is physically separated therefrom such that there is no direct contact therebetween. The resonator elements 110 further have a curved portion that forms a closed path or ring for each resonator element 110.

In the embodiment shown in FIG. 3, there are six resonator elements 110 with three elements on one lateral side of the conductive transmission line 42 and three resonator elements 110 on the opposite lateral side of the conductive transmission line 42. Each resonating element 110 is physically separated from the conductive transmission line 42, such that there is no direct contact between line 42 and resonating element 110. Instead, each resonating element 110 is electrically coupled via electromagnetic radiation such that RF energy is coupled to the resonators 110 that are placed in close proximity to the transmission line 42. By providing a series of resonator elements 110 (e.g., three resonators on each side), the RF energy is progressively coupled to the resonator elements 110 from the main transmission line 42 at the termination portion. The electrical energy that is coupled to the resonator elements 110 is circulated in the closed path of each resonator 110, according to the embodiment shown, and the energy is thereby dissipated into the dielectric substrate 48 due to substrate losses. The resonator elements 110 may be suitably designed to make use of a material loss (Tan σ) property to dissipate the energy, effectively acting like a termination over the desired frequency band.

The stripline termination circuit 100 is further shown having a plurality of plated via holes 52 extending between the top and bottom ground planes 44 and 46 and generally located around the outside of the conductive transmission line 42 and resonator elements 110. The plated via holes 52 form a fence along the stripline that minimizes interference with adjacent circuitry, and minimizes undesirable parallel plate modes. The plurality of via holes 52 may be formed in a single row, or may be formed in multiple rows in various shapes and sizes. It should be appreciated that the plurality of vias 52 may be provided in various numbers, orientations and shapes and may further be provided with a conductive plating to form the conductive vias. The dielectric substrate 48 may have a thickness and the via hole fence may have a width (edge-to-edge) distance between via hole rows on either side of the conductive transmission line 42 and resonator elements 52 as desired to provide desired functioning of the stripline termination circuit 100.

Figure 4:
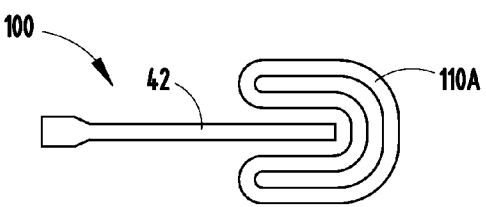
FIG. 4 is an enlarged top view of a stripline termination circuit employing a resonator element according to a second embodiment.

While the first embodiment of the resonator elements shows a closed loop that is generally ring-shaped, it should be appreciated that other shaped resonating elements may be employed to attenuate RF energy at the termination 100. Referring to FIG. 4, a stripline termination circuit 100 employing a resonating element 110A according to a second embodiment. In this embodiment, the resonating element 110A generally is configured as a U-shape or horseshoe-shape ring extending on both lateral sides of the conductive transmission line 42 and wrapping around the termination end. The U-shaped ring 110A couples electrical energy from the conductive termination line 42 into the dielectric substrate.

Figure 5:
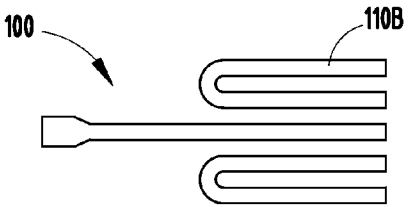
FIG. 5 is a top view of a stripline termination circuit employing a resonator element according to a third embodiment.

Referring to FIG. 5, a stripline termination circuit 100 is illustrated employing a pair of resonator elements 110B, according to a third embodiment. In this embodiment, each of the resonator elements 110B is fabricated as a U-shape element having parallel linear portions that are parallel to the transmission line 42 and a curved connecting portion at one end. A first U-shaped element 110B is provided on one lateral side of the conductive transmission line 42 and a second U-shape resonating element 110B is provided on the opposite second lateral side of the conductive transmission line 42.

Figure 6:
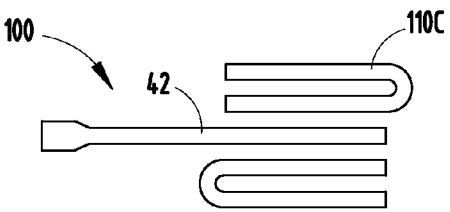
FIG. 6 is a top view of a stripline termination circuit employing resonator elements according to a fourth embodiment.

Referring to FIG. 6, a stripline termination circuit 100 is illustrated employing a pair of resonator elements 110C, each in a generally U-shape, according to a fourth embodiment. The resonator elements 110C have a shape similar to that shown in FIG. 5 in the third embodiment, except one of the resonator elements 110C is oriented one hundred eighty degrees (180°) relative to the other resonating element 110C.

Figure 7:
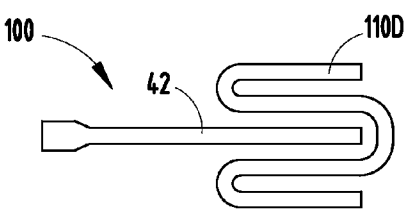
FIG. 7 is a top view of a stripline termination circuit employing a resonator element according to a fifth embodiment.

Referring to FIG. 7, a stripline termination circuit 100 is illustrated employing a resonator element 110D, according to a fifth embodiment. In this embodiment, the resonator ring includes portions that are similar to the resonator element 110B shown in the embodiment of FIG. 5, the exception that one end of each of the resonator elements 110D are connected together by a conductive element that wraps around the outer terminating end of the transmission line 42.

Figure 8:
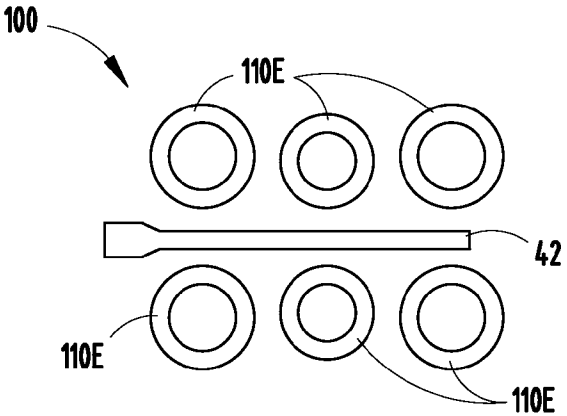
FIG. 8 is a top view of a stripline termination circuit employing resonator elements according to a sixth embodiment.

Referring to FIG. 8, a stripline termination circuit 100 is illustrated employing a plurality of resonator elements 110E, according to a sixth embodiment. In this embodiment, the resonator elements 110E are fabricated as circular rings provided with three rings each on opposite lateral sides of the conductive transmission line 42. The middle pair of conductive circular rings 110E is shown having a slightly smaller size and diameter as compared to the outer pairs of resonator elements 110E.

Figure 9:
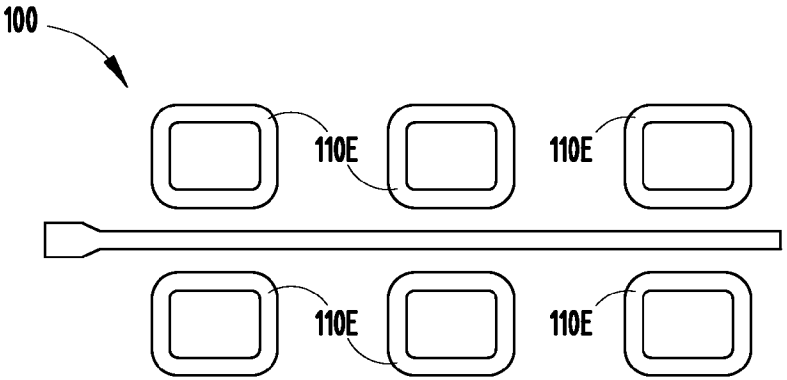
FIG. 9 is a top view of a stripline termination circuit employing resonator elements according to a seventh embodiment.

Referring to FIG. 9, a stripline termination circuit 100 is illustrated employing a plurality of resonator elements 110F, according to a seventh embodiment. In this embodiment, each of the resonator elements 110F are shown formed as substantially rectangular closed loops or rings. While various shapes, sizes, numbers of resonator elements 110-110F are shown and described herein, it should be appreciated that other resonator elements may be employed to couple RF energy such that it is attenuated from the stripline termination circuit 100 into the dielectric substrate 48.

Figure 10:
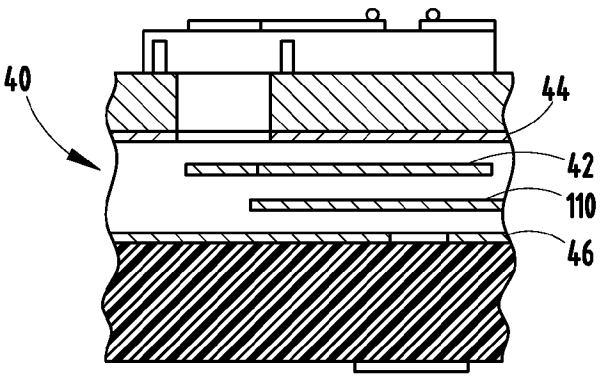
FIG. 10 is a cross-sectional view of a transceiver, employing a stripline termination circuit having the resonator element(s) provided below the conductive transmission line, in broad-side coupled stripline configuration, according to another embodiment.

The stripline termination circuit 100 has been shown and described herein in connection with one or more resonator elements that are located edge side coupled on the lateral sides of the conductive transmission line 110. However, it should be appreciated that the resonator elements may be formed at other locations other than the side lateral locations. Referring to FIG. 10, the resonator elements 110 may be located below the conductive transmission line 42 such that it is broad side coupled. Additionally, it should be appreciated that the resonator elements 110 may be located above the conductive transmission line 42, according to another embodiment. Accordingly, the resonator elements are located near the conductive transmission line 42 and its isolated termination port sufficiently close to provide an electromagnetic coupling, however, are not physically in direct contact with the conductive transmission line 42.

Figure 11:
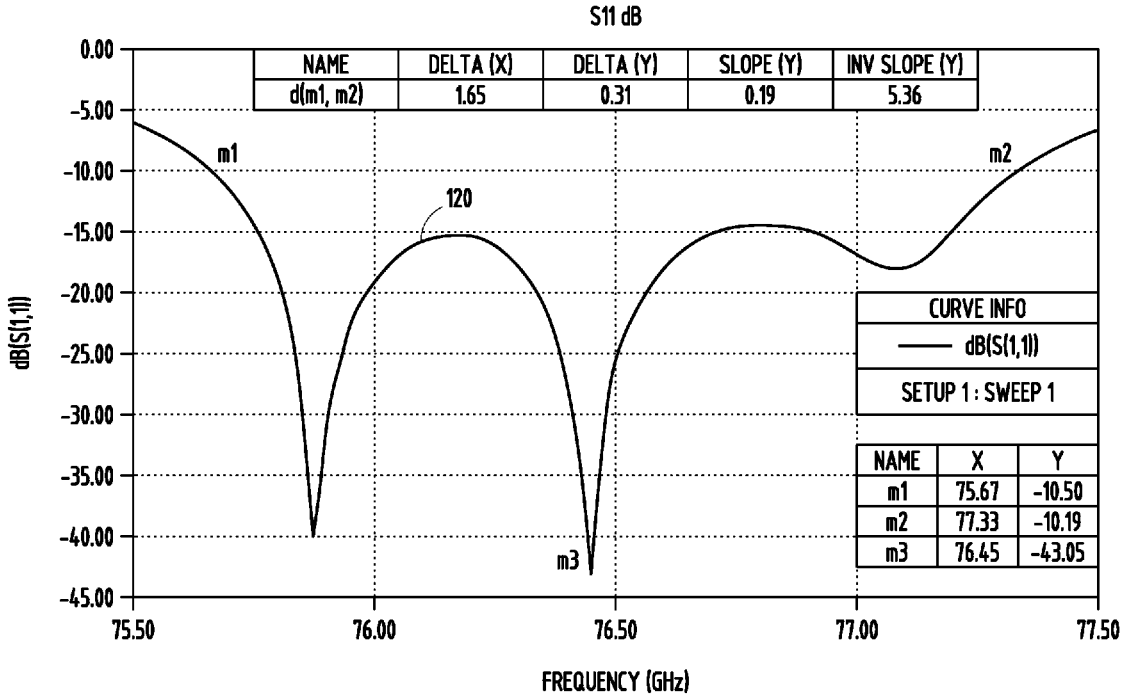
FIG. 11 is a graph illustrating simulated results achieved with the stripline termination circuit in the embodiment shown in FIG. 3.

The graph shown in FIG. 11 generally illustrates simulated results in decibels (dB) versus frequency in gigahertz (GHz) for RF signal dissipation in the stripline termination circuit 100. As can be seen, the stripline termination circuit 100 provides an efficient dissipation of RF energy centered about a frequency of about seventy-six and one-half gigahertz (76.5 GHz) and provides good termination and attenuation of electrical signals in the frequency range of seventy-six to seventy-seven gigahertz (76-77 GHz), according to one embodiment.

The stripline termination circuit 100 comprises a conductor strip placed between two metalized coplanar ground planes, separated by two dielectric substrates of predesigned thicknesses. RF energy present on the coupled strip is electrically coupled to one or more resonating elements over the desired frequency band and is dissipated in the dielectric substrates. The resonating elements are not in direct contact with the conductor strip, and are constructed in edge-coupled or broad-side coupled stripline configurations, according to various embodiments.

Accordingly, the stripline termination circuit 100 advantageously provides for the dissipation of RF energy from a conductive transmission line to one or more resonators via electrical coupling to dissipate energy into the dielectric substrate 48. The stripline termination circuit 100 advantageously employs the use of a stripline and eliminates the need for dispensable liquid absorbers, resistors and other hard to accommodate or expensive components and processes that are typically required to terminate an isolated port in the feed layer.

While a termination circuit is shown and described herein in connection with a stripline determination circuit 100, it should be appreciated that the termination circuit may be used to provide a termination circuit for other circuits. According to another embodiment, the termination circuit 100 may terminate an isolated port of a microstrip circuit which employs a single ground plane dielectrically isolated from a conductive transmission line, in contrast to a pair of ground planes. In a microstrip application, the termination circuit includes a first ground plane, a conductive transmission line having a termination end, a dielectric disposed between the first ground plane and the conductive transmission line to dielectrically isolate the conductive transmission line from the first ground plane, and one or more resonating elements electrically coupled to the conductive transmission line for dissipating energy from the transmission line into the dielectric to provide a termination over a desired frequency band, wherein the one or more resonating elements are not in direct contact with the conductive transmission line. The microstrip circuit may employ an edge-coupled configuration in which the resonators are coupled to an edge of the conductive transmission line within the same plane. It should further be appreciated that the termination circuit may be employed in other devices including, but not limited to, two-port devices such as an attenuator circuit according to further embodiments.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

The invention claimed is:

1. A termination circuit to terminate an isolated port, said termination circuit comprising:

a first ground plane;

a conductive transmission line having a termination end;

a dielectric disposed between the first ground plane and the conductive transmission line to dielectrically isolate the conductive transmission line from the first ground plane; and one or more resonating elements electrically coupled to the conductive transmission line for dissipating energy from the transmission line into the dielectric to provide a termination over a desired frequency band, wherein the one or more resonating elements are not in direct current contact with the conductive transmission line.

2. The termination circuit as defined in claim 1, wherein the termination circuit provides a predetermined impedance.

3. The termination circuit as defined in claim 1, wherein the one or more resonating elements are located to a lateral side of the conductive transmission line.

4. The termination circuit as defined in claim 1, wherein the one or more resonating elements are located in at least one of above and below the conductive transmission line.

5. The termination circuit as defined in claim 1, wherein the termination circuit is employed in a feed network.

6. The termination circuit as defined in claim 5, wherein the termination circuit operates to terminate signals at frequencies in the range of approximately 76-77 gigahertz.

7. The termination circuit as defined in claim 1, wherein the termination circuit comprises a microstrip termination circuit.

8. The termination circuit as defined in claim 7, wherein the one or more resonating elements are edge-coupled to the conductive transmission line.

9. The termination circuit as defined in claim 1, wherein the one or more resonator elements comprise one or more closed loop elements.

10. The termination circuit as defined in claim 9, wherein the one or more closed loop resonator elements comprise a plurality of closed loop resonating elements disposed on opposite sides of the conductive transmission line.

11. The termination circuit as defined in claim 9, wherein each resonating element has a straight portion aligned substantially parallel to the conductive transmission line.

12. The termination circuit as defined in claim 9, wherein each resonating element has a circular portion.

13. The termination circuit as defined in claim 1, wherein the termination circuit comprises a stripline termination circuit further comprising a second ground plane, wherein the dielectric is disposed between the first and second ground planes and dielectrically isolated the first and second ground planes.

14. The termination circuit as defined in claim 13 further comprising a plurality of conductive vias extending through the dielectric and connected to the first and second ground planes on opposite sides of the conductive transmission line and one or more resonating elements.

15. The termination circuit as defined in claim 13, wherein the first ground plane is on one side of the conductive transmission line and the second ground plane is on an opposite side of the conductive transmission line, and wherein the dielectric is disposed between the conductive transmission line and each of the first and second ground planes.

16. A stripline termination circuit to terminate an isolated port, said stripline termination circuit comprising:

a first ground plane;

a second ground plane;

a dielectric disposed between the first and second ground planes to dielectrically isolate the first and second ground planes;

a conductive transmission line disposed between the first and second ground planes and dielectrically isolated by the dielectric, said conductive transmission line having a termination end; and one or more resonating elements electrically coupled to the conductive transmission line for dissipating energy from the transmission line into the dielectric to provide a termination over a desired frequency band, wherein the one or more resonating elements are not in direct current contact with the conductive transmission line.

* * * * *